US011168409B2

(12) United States Patent
Vanhee et al.

(10) Patent No.: US 11,168,409 B2
(45) Date of Patent: Nov. 9, 2021

(54) FACILITY AND METHOD FOR LOCALIZED SURFACE TREATMENT FOR INDUSTRIAL COMPONENTS

(71) Applicants: COCKERILL MAINTENANCE & INGENIERIE S.A., Seraing (BE); IRT ANTOINE DE SAINT EXUPERY, Toulouse (FR)

(72) Inventors: Luc Vanhee, Oisy le Verger (FR); Daniel Gmur, Grenay (FR)

(73) Assignees: COCKERILL MAINTENANCE & INGENIERIE S.A., Seraing (BE); IRT ANTOINE DE SAINT EXUPERY, Toulouse (FR)

( * ) Notice: Subject to any disclaimer, the term of this patent is extended or adjusted under 35 U.S.C. 154(b) by 0 days.

(21) Appl. No.: 16/971,731

(22) PCT Filed: Jan. 23, 2019

(86) PCT No.: PCT/EP2019/051663
§ 371 (c)(1),
(2) Date: Aug. 21, 2020

(87) PCT Pub. No.: WO2019/162026
PCT Pub. Date: Aug. 29, 2019

(65) Prior Publication Data

US 2020/0392638 A1 Dec. 17, 2020

(30) Foreign Application Priority Data

Feb. 26, 2018 (EP) ..... 18158520

(51) Int. Cl.
*C25D 17/02* (2006.01)
*C25D 11/00* (2006.01)
(Continued)

(52) U.S. Cl.
CPC ..... *C25D 11/005* (2013.01); *C25D 5/02* (2013.01); *C25D 17/004* (2013.01); *C25D 17/02* (2013.01); *C25D 21/04* (2013.01); *C25D 21/12* (2013.01)

(58) Field of Classification Search
None
See application file for complete search history.

(56) References Cited

U.S. PATENT DOCUMENTS 5,173,161 A 12/1992 Gramm
5,279,725 A * 1/1994 Westerman, Jr. ..... C25D 5/02 204/224 R (Continued)

FOREIGN PATENT DOCUMENTS

FR 2310425 A1 12/1976
GB 1551340 A 8/1979
WO WO 2016071633 A1 5/2016

*Primary Examiner* — Stefanie S Wittenberg
(74) *Attorney, Agent, or Firm* — Leydig, Voit & Mayer, Ltd.

(57) ABSTRACT

A station for localized surface treatment of an industrial workpiece to be treated includes: at least one treatment chamber having a cell or two half-cells, each cell or half-cell delimiting a tight space between walls of the cell or half-cell and a respective portion or face of the industrial workpiece, the cell or each half-cell having a wall having an opening for covering a corresponding portion or face of the industrial workpiece, the opening of the cell or half-cell being delimited by a continuous sealing gasket, the cell or each half-cell including positioning means, the at least one treatment chamber having a supply and emptying circuit; and a plurality of storage vats each containing a treatment fluid, the supply and emptying circuit connecting each storage vat to the at least one treatment chamber so as to supply the at least one treatment chamber with respective treatment fluids.

20 Claims, 11 Drawing Sheets

(51) Int. Cl.

| | |
|---|---|
| ***C25D 5/02*** | (2006.01) |
| ***C25D 17/00*** | (2006.01) |
| ***C25D 21/04*** | (2006.01) |
| ***C25D 21/12*** | (2006.01) |

(56) References Cited

U.S. PATENT DOCUMENTS

| | | | | |
|---|---|---|---|---|
| 5,458,755 | A * | 10/1995 | Fujiyama | C25D 5/022<br>204/224 R |
| 2018/0195191 | A1 | 7/2018 | Rives | |
| 2018/0223444 | A1* | 8/2018 | Yokoyama | C25D 5/028 |

* cited by examiner

FACILITY AND METHOD FOR LOCALIZED SURFACE TREATMENT FOR INDUSTRIAL COMPONENTS

CROSS-REFERENCE TO PRIOR APPLICATIONS

This application is a U.S. National Phase application under 35 U.S.C. § 371 of International Application No. PCT/EP2019/051663, filed on Jan. 23, 2019, and claims benefit to European Patent Application No. EP 18158520.9, filed on Feb. 26, 2018. The International Application was published in French on Aug. 29, 2019 as WO 2019/162026 under PCT Article 21(2).

FIELD

The present invention relates to a facility and a method for localized surface treatment for industrial workpieces, over a 2D or 3D geometry and a predetermined and perfectly delimited surface area.

BACKGROUND

The invention in particular relates to the localized treatment of aeronautical workpieces having large dimensions, and in particular the local repair of the pre-existing surface treatment of workpieces having been friction stir welded (FSW).

The invention can also be applied in any industrial sector where a localized surface treatment must be done, whether in the field of production (new production) or that of repairs (maintenance).

It is known in many applications, whether they belong to the automotive or aeronautical field for instance, that the surface treatment of workpieces, and in particular of large workpieces, can be done before the assembly of the parts with one another. For example, the workpieces may undergo a set of treatments to improve their protection or to functionalize their surface before being assembled by bolting or riveting. These treatments are generally done by quenching of the workpieces in one or several successive baths containing the treatment products, so as to obtain a qualified coating that is compliant with the field of usage of the workpiece. A treatment sequence may for example consist of the successive steps of: degreasing, rinsing, stripping, rinsing, conversion treatment, rinsing, passivation, rinsing and drying.

Thus, in the particular field of aeronautics, the weight of the workpieces and assemblies is one important constraint. To significantly decrease the weight of airplanes, the assembly by bolting or riveting may for instance be advantageously replaced by the friction stir welding (FSW) technique. This technique makes it possible to assemble two workpieces in the solid state, using a non-consumable tool and without melting the material of the workpieces to be assembled. The drawback of this technique is the deterioration of the surface coating of each workpiece near the weld done by friction stir welding, following the production of the weld itself and/or the cleaning thereof.

Thus, if a part of the surface must be repaired or touched up, it would be interesting to produce on this portion the same treatment as the treatment defined during the production thereof. It is therefore necessary to apply a localized surface treatment using a succession of chemical solutions applied in the correct concentrations and temperatures and just where this is necessary, on a surface that may have a complex three-dimensional geometry. One solution is to develop a treatment cell adapted to the geometry and dimensions of the workpiece, this cell having to be mechanically and chemically compatible with different solutions and having to ensure perfect tightness.

Document WO 2016/071633 A1 (or FR 3 027 826 A1) describes a system and a method for local surface treatment of industrial workpieces. According to this technique, the assembled workpiece can be treated locally in damaged locations. The disclosed system comprises a plurality of reservoirs comprising chemical treatment products, as well as treatment cells, called "bath boxes", making it possible to delimit a tight space located on the workpiece to be treated. A controlled pressure circuit comprising a set of valves makes it possible to supply the cells with the treatment products contained in the different reservoirs. In this way, a workpiece can be treated locally, coated or painted with products identical to those used in the techniques for dipping whole workpieces in baths. This technique makes it possible not to endanger the quality and any certifications of the treatment relative to dipping in a bath, in the case of workpieces welded after this surface treatment of the individual workpieces by bath.

In the state of the art, there are no industrial and automated facilities of this type, making it possible to reproduce the succession of surface treatments developed during the initial production of the workpiece. The existing solutions generally consist of a mechanical preparation with or without an addition of material and a local paint. They can also implement an alternative, and therefore lower-performing surface treatment, applied manually, either with a paintbrush or with a buffer (example: electrolysis with Dalistick™). In this case, the treated zone is not covered tightly, and this results in flows that generate losses of solution and can pollute or alter the zones adjacent to the zone needing the treatment. This treatment is for example a passivation treatment that can also promote the adherence of the paint that will cover the zone. If different successive chemical treatments must be applied one after another, this is done in several steps, not in the same device and generally not automatically.

Document U.S. Pat. No. 5,173,161 A relates to a device and a method for using the device to apply and/or remove a coating on manufactured workpieces. The device comprises a device for transporting fluid and a container suitable for receiving the manufactured workpieces. The container comprises an input line connected to a fluid source, an output line connecting the container to the fluid source, the fluid source being positioned below the transport device, and a control device connecting the input and output lines to the fluid source. The transport device is a vacuum pump incorporated into the output line of the container.

SUMMARY

In an embodiment, the present invention provides a station for localized surface treatment of an industrial workpiece to be treated, comprising: at least one treatment chamber comprising a cell or two half-cells, each cell or half-cell being configured to delimit a tight space between walls of the cell or half-cell and a respective portion or face of the industrial workpiece, the cell or each half-cell comprising a wall having an opening configured to cover a corresponding portion or face of the industrial workpiece, the opening of the cell or half-cell being delimited by a continuous sealing gasket, the cell or each half-cell comprising positioning means, the at least one treatment chamber comprising a supply and emptying circuit; a plurality of storage vats each configured to contain a treatment fluid, the supply and emptying circuit connecting each storage vat to the at least one treatment chamber so as to supply the at least one treatment chamber with respective treatment fluids, the plurality of storage vats being located at a lower level than the at least one treatment chamber; and a system configured to decrease pressure with respect to atmospheric pressure of the at least one treatment chamber and the supply and emptying circuit, allowing the supply, and respectively the emptying, of the at least one treatment chamber, during a pressure decrease, due to a suction of treatment fluid through the supply and emptying circuit from the plurality of storage vats to the at least one treatment chamber, respectively, when the supply and emptying circuit is set to atmospheric pressure, due to a return by gravity of the treatment fluid to the storage vats, wherein the sealing gasket is configured to ensure the tight space delimited between the walls of the cell or half-cell and the respective portion or face of the industrial workpiece by inflating the sealing gasket with air to a pressure of between 0 and 5 bars once the positioning means have positioned the cell or each half-cell at several tenths of a millimeter from a surface of the industrial workpiece.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
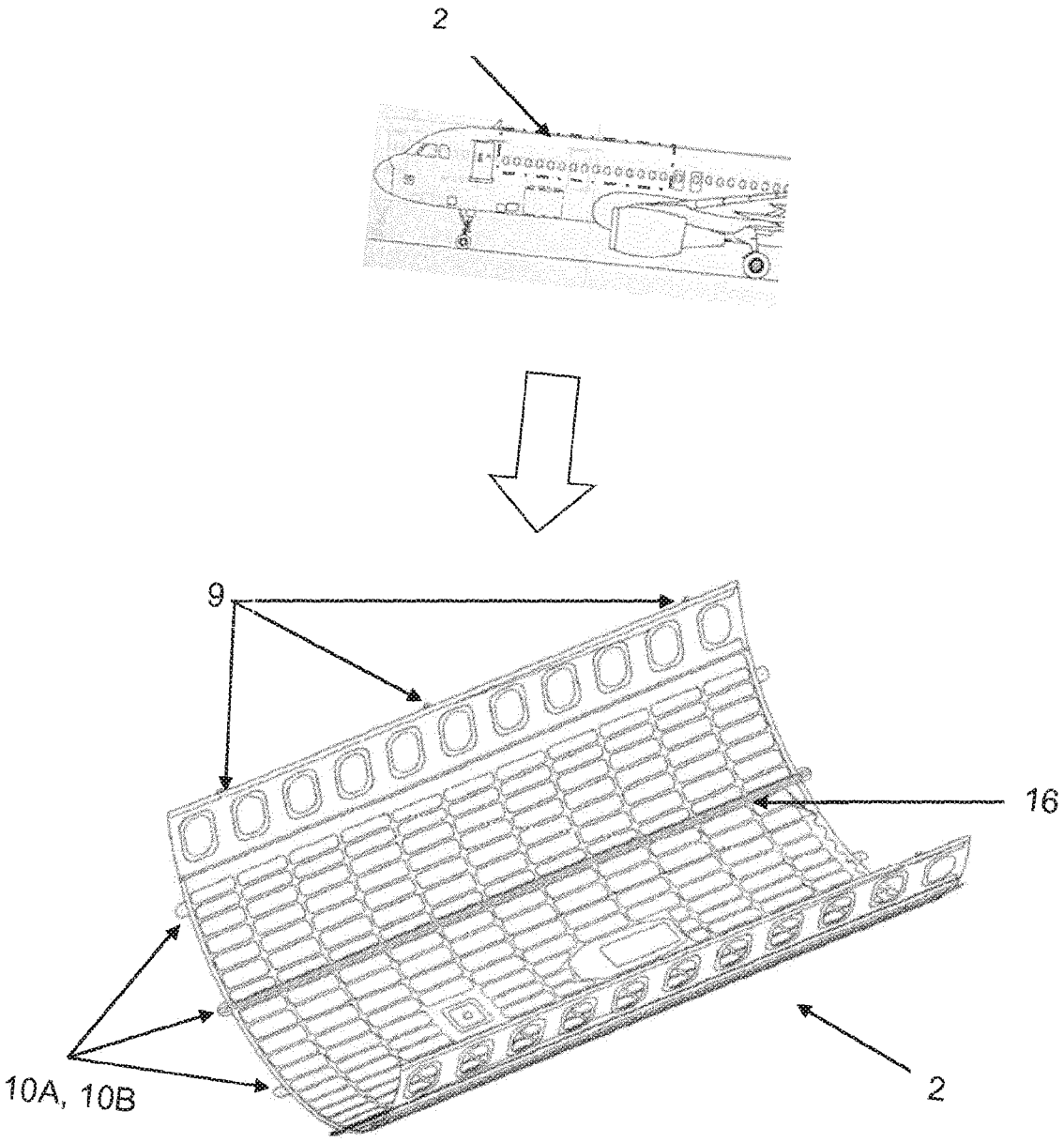
FIG. 1 shows an exemplary airplane part to be treated with the facility and the method according to the invention as well as the location of this part within the cockpit of an Airbus A320.

In an embodiment, the present invention provides a solution for the local treatment of large industrial workpieces (typically up to 10 meters long), a portion of which has been locally damaged following a method such as welding.

In an embodiment, the present invention provides an apparatus having cells with perfect tightness so as to locally allow an exact reproduction of the surface treatment protocol described by the airplane manufacturers (e.g., AIPI 02-01-003 by Airbus).

In an embodiment, the present invention provides an equipment item and cells suitable for locally performing a surface treatment with the adequate solution parameters and performing an electrolytic surface treatment such as anodization, in a context with the following constraints: rapid temperature change (from ambient temperature to 70° C., for example, and vice versa), use of corrosive solutions (acids, alkalines, etc.), treatment of long and narrow workpieces, with 2D or even 3D shape, distribution of current and electrical insulation in the case of electrolytic treatment, rapid treatment (filling, emptying) due to the passage of a large number of solutions (e.g., >10) in the cells, and lastly, need for tightness in a thermal expansion context.

In an embodiment, the present invention ensures the integration of a specific complex treatment system in an industrial production line, continuous or with treatment by successive baths.

In an embodiment, the present invention provides an equipment item that allows a treatment equivalent to a treatment with a buffer, but which, while being tight, prevents environmental pollution with the treatment products and makes it possible to protect adjacent surfaces on the workpiece with respect to leakage, as well as to protect the user.

In an embodiment, the present invention provides a use both for production and in maintenance or local repair operations, either on both faces at once, or on a single surface at a time.

A first aspect of the present invention relates to a station for localized surface treatment of an industrial workpiece to be treated comprising:

at least one treatment chamber formed by a cell or two half-cells, each cell or half-cell being suitable for delimiting a tight space between the walls of said cell or half-cell and a respective portion or face of the workpiece to be treated, the cell or each half-cell comprising a wall having an opening suitable for covering the corresponding portion or face of the workpiece to be treated, the opening of the cell or half-cell being delimited by a continuous sealing gasket, the cell or each half-cell comprising positioning means;

a plurality of storage vats each able to contain a treatment fluid;

a supply and emptying circuit of the treatment chamber connecting each storage vat to the treatment chamber so as to supply the treatment chamber with the respective treatment fluids;

characterized in that:

the treatment station comprises a system for decreasing pressure with respect to the atmospheric pressure of the treatment chamber and the supply and emptying circuit allowing the supply, respectively the emptying, of the chamber owing, during said pressure decrease, to the suction of treatment fluid through the supply and emptying circuit from the storage vats to the treatment chamber, respectively, when the supply and emptying circuit is set to atmospheric pressure, owing to the return by gravity of the treatment fluid to the storage vats, which are located at a lower level than the treatment chamber;

the tight space delimited between the walls of said cell or half-cell and a respective portion or face of the workpiece to be treated is ensured by a sealing gasket inflated with air at a pressure of between 0 and 5 bars, preferably between 1 and 2 bars, once the means for positioning the cell or each half-cell have positioned the latter at several tenths of a mm from the surface of the workpiece to be treated.

According to preferred embodiments of the invention, the station for localized surface treatment further comprises one of the following features or a suitable combination of the following features:

the cell or each half-cell is made from a metal coated on the surfaces in contact with the fluids by means of a coating suitable for withstanding the corrosion of the fluids and the operating temperatures; it may also be made from synthetic materials, for instance polypropylene or PVDF;

the continuous sealing gasket is an inflatable lip seal preferably made from EPDM;

the pressure-decrease system of the chamber comprises at least one vacuum pump, a vacuum-breaker valve for measuring and regulating the vacuum and a seal pot or vacuum-regulating balloon, the seal pot being connected to the vacuum pump by a condenser that condenses the vapors generated by the pressure decrease;

the vacuum pump is a liquid-ring centrifugal pump;

the supply and emptying circuit comprises thermally insulated pipes;

the treatment chamber comprises means for agitating the treatment fluid in the tight space;

the cell or each half-cell comprises an electrode for an electrochemical treatment of the workpiece to be treated;

it comprises a handling gantry suitable for transporting the workpiece from a depositing carrier of a previous station to a depositing carrier of the treatment station, owing to a variable diameter that allows it to approach the workpiece without touching it and suction devices that allow the contact and holding by pressure decrease of the workpiece (2) with said depositing carrier (11);

it comprises a structure, making it possible to retract and position the treatment cell or half-cells, and which is provided with a plurality of positioning jacks that make it possible to position the cell or the half-cells on each side of and near the workpiece to be treated and optionally jacks for placing the cell or half-cells on the workpiece to be treated so as to produce the tight chamber, if applicable by clamping it;

it is designed to apply a localized surface treatment on large industrial workpieces having protuberances called lugs made at each end of the weld, said lugs being centered on the axis of the weld and allowing the beginning and end of welding, said lugs having either a removable part that is detachable and usable as test specimen, for example to perform a nondestructive test, or as remaining part which may be bored to allow communication of fluids between the half-cells;

the tightness of the treatment chamber is ensured by the continuous sealing gasket longitudinally on each side of the weld and on the remaining part of the lugs at the ends of the weld.

The invention also relates to a production line for industrial workpieces comprising a first assembly station for the workpieces comprising a welding step, a second nondestructive testing station for the produced welds, a station for localized treatment of the workpieces according to the description above and a final inspection station for the treated workpieces.

A second aspect of the present invention relates to a method for localized surface treatment of an industrial workpiece to be treated implementing the treatment station according to the treatment station described above, characterized by the following steps:

setting a pressure-decrease level in the pressure-decrease system, at a value that is at most 500 mbar, preferably 200 mbar and still more preferably 100 mbar, lower than the atmospheric pressure;

opening the valves and filling by suction the seal pot or vacuum-regulating balloon up to a predetermined level with a treatment fluid coming from a storage vat;

circulating, by pumping, the treatment fluid coming from a storage vat and filling the treatment chamber;

treating the workpiece to be treated;

stopping the circulation of the treatment fluid;

stopping the pressure decrease, returning to atmospheric pressure and emptying, by gravity, the treatment fluid to the storage vat.

Advantageously, the method is repeated for the treatments with different fluids, optionally intercut by rinsing, so as to form a treatment cycle.

Preferably, at the end of a treatment cycle, the treated zones of the workpiece are dried by dried and heated air for about 5 minutes.

A third aspect of the invention relates to a use of the method previously described, in a manufacturing process to ensure a functionality or an additional assembly, or during a maintenance or repair operation of a workpiece that is already in use.

Typically the invention proposes a treatment facility that is intended to locally treat a zone having a friction stir weld with a width of +/−30 mm on a large workpiece that may reach up to 6 and even 10 m long.

The facility according to the invention therefore comprises at least one cell (in the case of a single workpiece face to be treated) or two half-cells (in the case of two workpiece faces to be treated) suitable for being placed using jacks, or any other appropriate application device, around the weld, if applicable a half-cell on each side of the workpiece, the pressure and the placement of the cells being controlled. A partial vacuum is advantageously established in the cell, which makes it possible to fill and empty the latter quickly with the appropriate products. Thus, in case of leak, the ambient air returns into the cell and the product is prevented from exiting. The cell will preferably be made from coated steel or coated aluminum so as to have a thermal expansion coefficient similar or identical to that of the workpiece to be treated, the coating being deposited on the surfaces in contact with the fluid, to withstand the different solutions used and the temperatures of the methods used. If one of the provided treatments is electrochemical (e.g., anodization), the cell will be provided with specific electrodes compatible with the different solutions entering the cell. This facility allows both chemical and electrochemical treatments, as well as the drying of the cells and treated workpieces before opening of the cells. In this case, the cells or half-cells will have to be electrically insulated. The coating or the choice of the construction materials for the cells or half-cells can fill this role.

The proposed solution consists of a treatment cell in which the identical successive treatments will be reproduced, according to the same operating mode as those used during the initial manufacture of the workpiece. The invention relates to the implementation of this solution. This solution can be applied either on a single face, or on several faces, for example on either side of a wall. It can be applied during a maintenance or repair operation of the workpiece that is already in use (for example a touch up on the surface of the fuselage of an airplane). However, it may also be done during a production process, for example when a portion of the surface(s) already treated beforehand requires a local modification to provide an additional functionality or an assembly.

The originality that is the subject matter of this invention does not lie exclusively in the equipment allowing this treatment, which is already known in part and is in particular disclosed in WO 2016/071633 A1, but also in the implementation of the solution. According to the invention, the equipment is provided and designed to work at a pressure below atmospheric pressure. The pressure-decrease level is sufficient to contribute to the tightness of the device and to make it possible, in case of local break in the mechanical tightness system of the cell, to generate an air inlet rather than a fluid leak to the outside, the air being subsequently separated from the solutions. However, the pressure-decrease level must be low enough to limit the evaporation of part of the solutions, more specifically when the latter must be hot.

The evaporated portion is then condensed and can be returned to the solution storage areas. To ensure tightness on a workpiece having a complex geometry that may be three-dimensional, the invention advantageously proposes an inflatable seal that is optionally replaceable for certain applications by another type of seal (O-ring or "music note," for example). This seal will allow a limited force on the surface of the workpiece while fitting its geometry. It will further make it possible to stop/localize the body of the cell at several tenths of a mm from the surface of the workpiece and, by inflation, to fill in this gap. It offers a surface that can be planar, optionally with one or several lips providing the tightness and lastly, in case of non-continuous surface, and when the discontinuity represents several tenths of a mm, it makes it possible to fill in part of the orifice thus generated and minimizes the possible entry of air into the system.

According to one exemplary embodiment, the proposed solution consists of reproducing, on a weld bead, which can be up to 6 m long and 22 mm wide, the preparation and anodization treatment as described in document AIPS 02-01-003 by Airbus. In this case, the cell in which the different treatment solutions and the intermediate rinses will follow one another is for example a cavity being 6 m long, 40 mm wide on the inside, having a depth of about 50 mm. Two similar cells, but arranged symmetrically on either side of the part to be repaired, make it possible to close them on the part and to simultaneously treat both faces of the weld bead. The curve radius of the part creates deviations relative to a planar surface for example of +/−0.4 mm. The two half-cells are positioned using jacks on either side of the workpiece at a distance of several tenths of a mm, but adjustable by adjustable stops. The device is then pinned in place. The tightness is for example ensured by a seal, preferably inflatable, made from EPDM, having a width of 12 mm and inflated with air. The latter is kept in place over its 12 m in circumference by a lip pinched on the side, between the half-cell and a holding workpiece. The inflation air pressure is for example adjustable between 0 and 5 bars. A pressure of 1 to 2 bars is preferred. At each end, the treatment cell is connected to the reservoirs of chemical solution tightly and in a submerged manner. The two connections allow the circulation of the fluid in the treatment chamber. This ensures the renewal of the solution, the turbulence necessary for the treatments, the heat input necessary to maintain a uniform temperature as well as the discharge of the incoming gases or the gases produced during the treatments. A set of valves allows the passage from one treatment solution to another.

The pressure decrease is preferably provided by a liquid-ring centrifugal pump, but any other pressure-decrease system can be considered. The pressure decrease is measured and regulated by a vacuum-breaker valve. The suction is done through a seal pot (or vacuum-regulating balloon) ensuring the filling of the two half-cells and facilitating the regulation of the pressure decrease. The vacuum pump is connected to this seal pot through a condenser making it possible to condense the vapors emitted naturally or generated by the pressure decrease.

The work cycle for a treatment is then as follows:

1. Generation of the pressure decrease;
2. opening of the valves and filling by pressure-decrease suction of the seal pot up to a desired level, then adjustment of the pressure decrease;
3. circulation of the treatment fluid;
4. treatment strictly speaking;
5. stopping the circulation of the fluid;
6. stopping the vacuum and return of the treatment fluid into the appropriate storage unit.

Such a device also makes it possible to dry the workpiece at the end of the cycle.

The present invention proposes a system for local surface treatment, for example treatment in the vicinity of welds of workpieces having been friction stir welded (FSW). These workpieces, before being assembled, have undergone several surface treatments, but the surface in the location of the weld has been damaged following the assembly by friction and the production/cleaning of the weld.

In the applications relative to FSW on structural workpieces, the workpieces to be treated are generally at most 10 m long, 4 m wide (diameter). These are for example half-tubes of the same type as illustrated (shown in dotted lines on the cockpit of an Airbus A320) in FIG. 1. Here, the welds given as an example are longitudinal and are 2D welds. They will serve as an illustration in the description of the facility below, without the longitudinal nature or any other property of these welds being limiting with respect to the scope of the invention. These workpieces generally have a mean thickness for example of 1.9 mm in the case of airplane workpieces, but may be locally thinner or thicker (thickness typically varying from 1.2 mm to 6 mm in the case of airplane workpieces).

The design will be easily transposable to other dimensions and geometries, in particular complex 3D geometries. Indeed, each weld may be different and should be treated specifically by a suitable cell in terms of its dimensions and geometric characteristics. It may in particular have several curves.

Production Line and Handling Gantry

Figure 2:
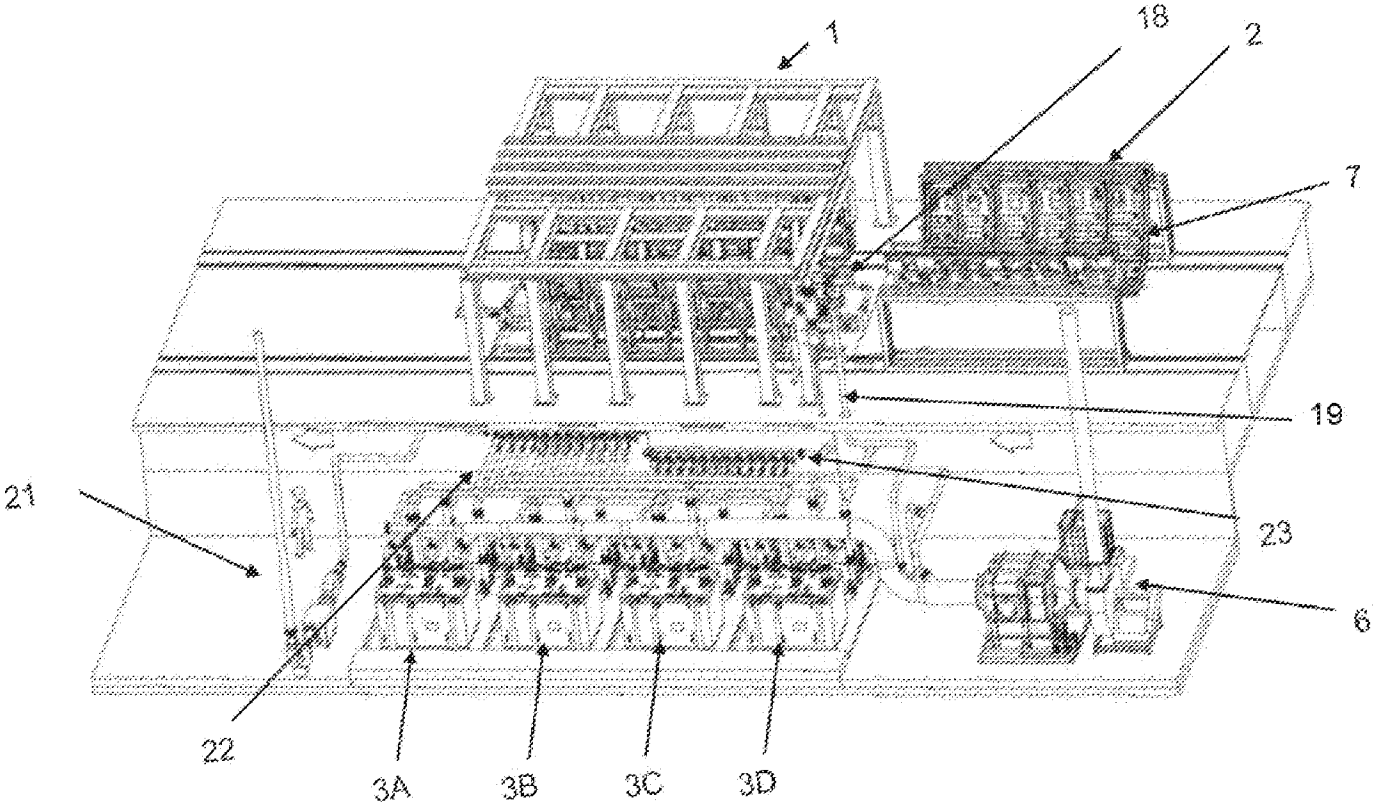
FIG. 2 shows an overview of one embodiment of an industrial station for local treatment according to the invention.

The surface treatment facility according to the invention can be integrated into a conventional production line, already known, and adapted to the industrial context (with different material flows, handling of workpieces to be treated, etc.). For example, the production line in which the facility according to the invention is integrated is preferably arranged longitudinally, and is made up of several successive stations, generally:

a first station, the assembly station, where the workpieces are arranged, fastened, machined, then welded;

a second station for nondestructive inspection of the welds;

a local treatment station 1 shown in FIG. 2;

a final inspection station.

In the local treatment station 1 (FIG. 2), each welding location will be "enclosed" in a tight cell for its treatment with different chemical products or fluids (see below). The different treatment fluids (for example respective degreasing, stripping, pickling, anodization, etc. fluids) are stored in storage vats 3A, 3B, 3C, 3D, etc. located below the treatment station 1 strictly speaking and are brought sequentially, one after the other, through a vacuum system 6 automatically creating the pressure decrease in the cells.

Figure 3:
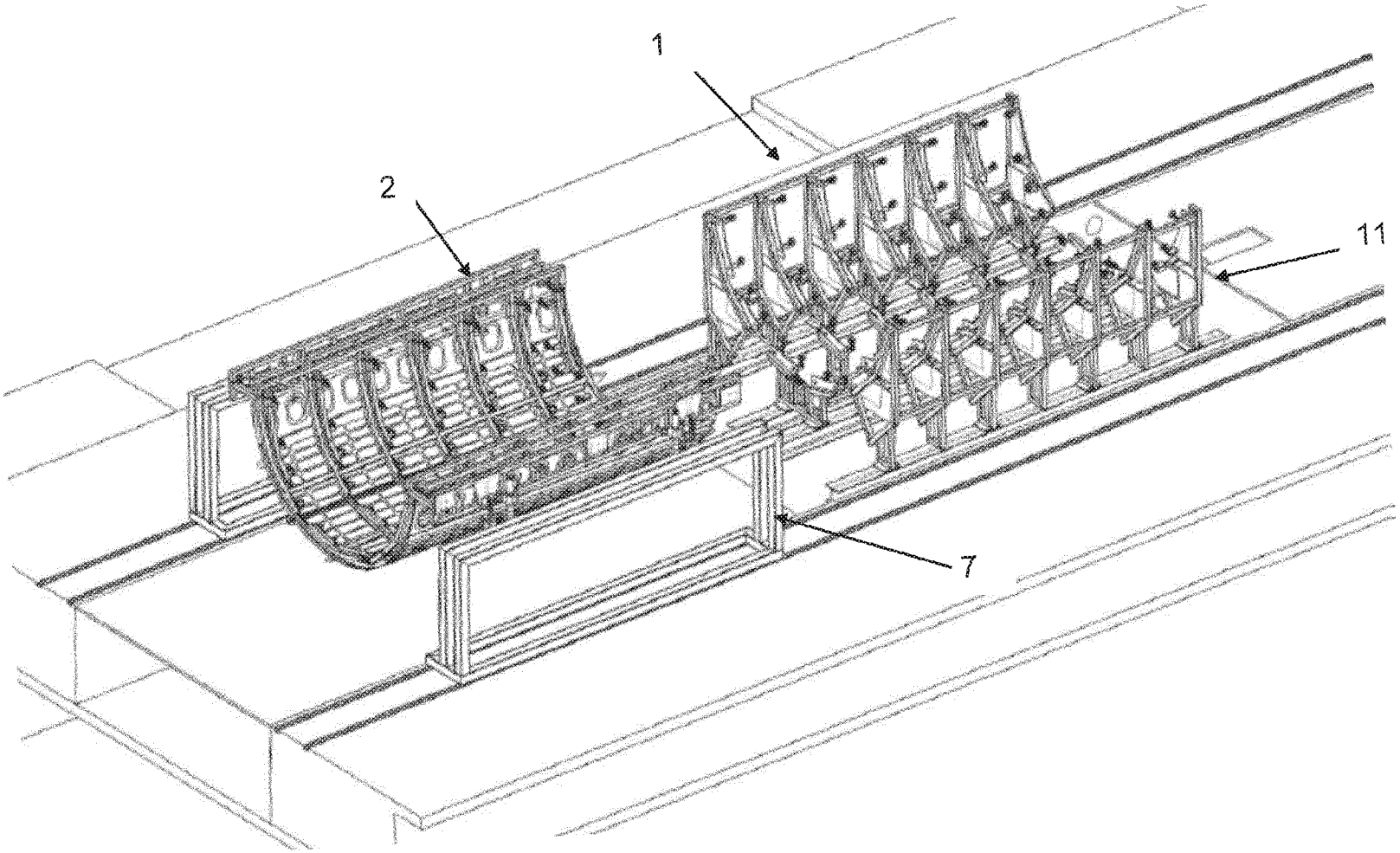
FIG. 3 shows an embodiment for the carrier of the depositing station and the transport gantry.

The workpiece to be treated 2 is maintained using suction devices (not shown) and moved from one station to another, in the case at hand on a suitable carrier 11 (depositing station) located in station 1, using a transport gantry or handler 7 (FIG. 3). This transport tool 7 has the ability to localize its location on each station and to localize the location of the workpiece to be moved.

Advantageously, the gantry 7 has a variable diameter, which allows it to pick up the workpiece 2 deposited in the preceding station, the gantry being adjusted to its smallest diameter before next adjusting to the diameter of the workpiece (its maximum diameter), but without touching it. Suction devices (not shown) in contact with the workpiece will then, by pressure decrease, "press" the workpiece against the carriers, for example made from Ertalon®, included in the structure of the gantry 7. The gantry 7 will then bring the workpiece to its minimum diameter and close it by simple pivoting of the upper portions and will next lift it and transport it to the following station. The depositing mechanism is done similarly, but reversed.

Workpiece to be Treated

The workpiece to be treated 2, a typical example of which is shown in FIG. 1, is a set of elements assembled by FSW welds 16 done on the assembly station. Before the welding step, the workpieces 2 have been manufactured by machining and have undergone a surface treatment. They have for example been degreased, prepared, anodized and painted. For example, the painting is an anti-corrosion primer and of course cannot be damaged during treatment or handling.

Both faces of the weld beads 16 therefore have untreated surfaces. On the upper face, these zones are for example stripped by machining with the milling cutter. On the lower face, these zones are for example stripped due to masking with scotch tape during the treatments. The two welds 16 making up the assembly are preferably re-treated simultaneously in the station 1.

Figure 10:
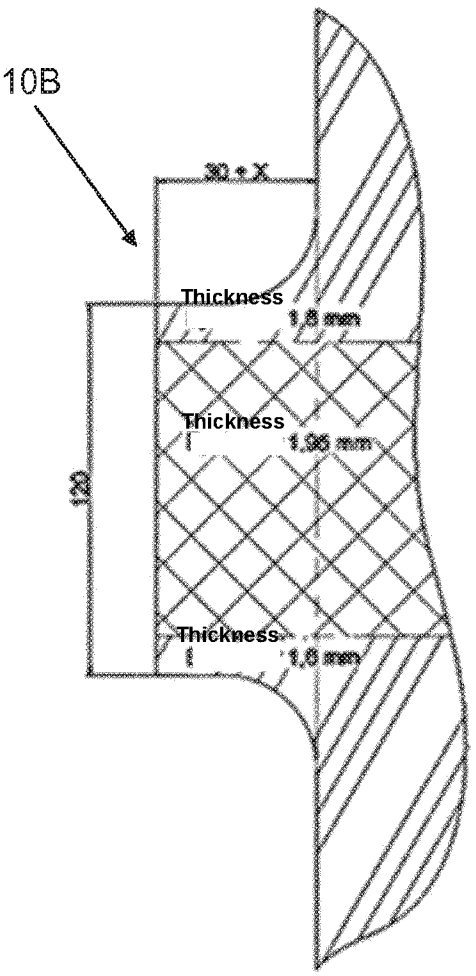
FIG. 10 schematically shows the lugs located at the ends of the welds, before and after elimination of the test specimens.
Figure 10:
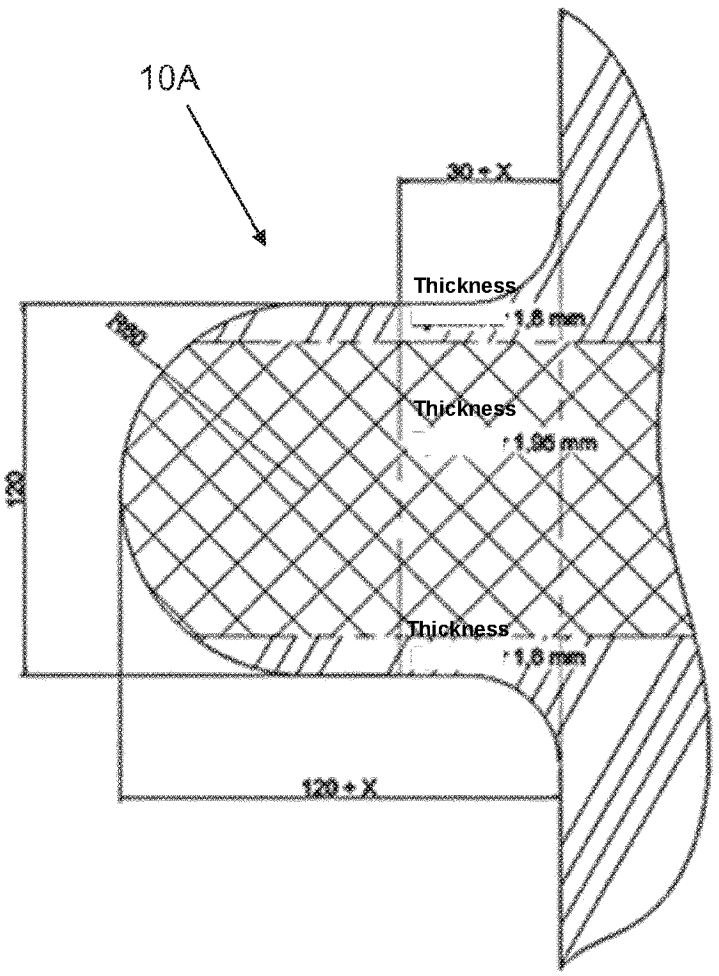
Figure 11:
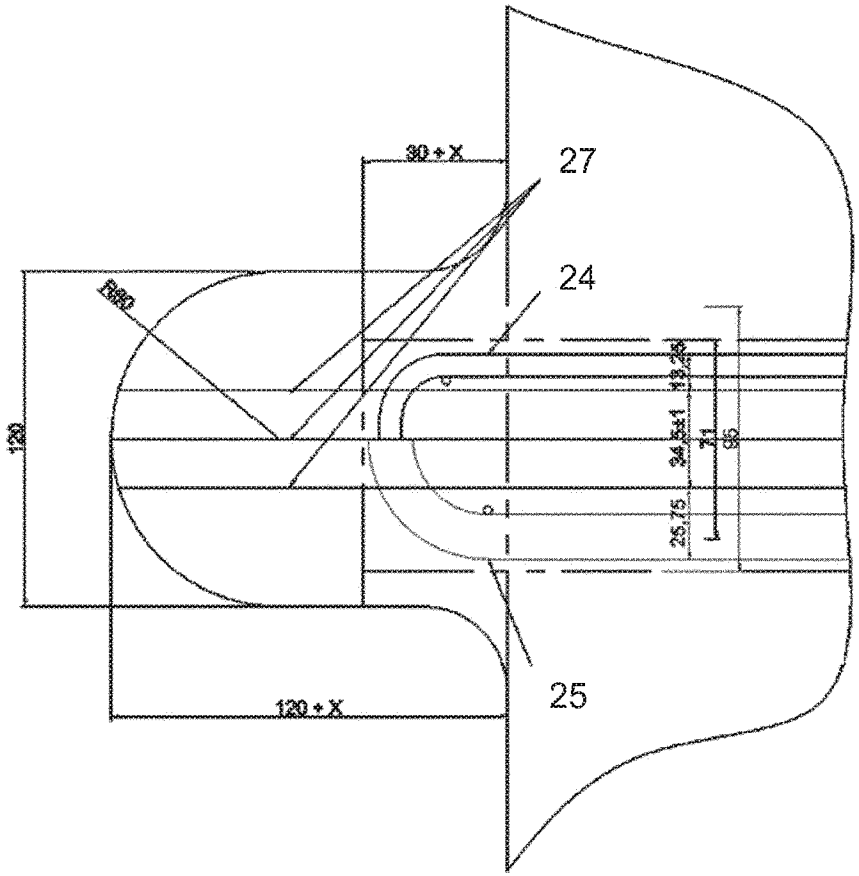
FIG. 11 is the installation layout of the seals on the remaining part of the lugs (with an example showing two different seals according to a larger or smaller width of the chamber).

In the context of the invention, the workpiece to be treated 2 comprises lugs 9, 10A, 10B, as illustrated in FIGS. 1, 10 and 11, some of which are bored, used to fix or transport the workpieces and the precise locatings are also used to locate the workpiece. Lugs 10A, 10B are also produced at each end of the weld 16 and are centered on the axis thereof, to allow the beginning and the end of the weld 16 (FIGS. 10 and 11). After welding, the lugs 10A are partially cut (into lugs 10B) to produce test samples, for analysis purposes (nondestructive inspection) and to eliminate the unfit portions of the weld 16 (FIG. 11).

In the remaining zone of the lugs 10B for beginning and ending the weld 16, borings can be made. They will allow a communication between the treatment chambers and the discharge for the liquid or gas, as explained below.

Localized Surface Treatment Station

Figure 5:
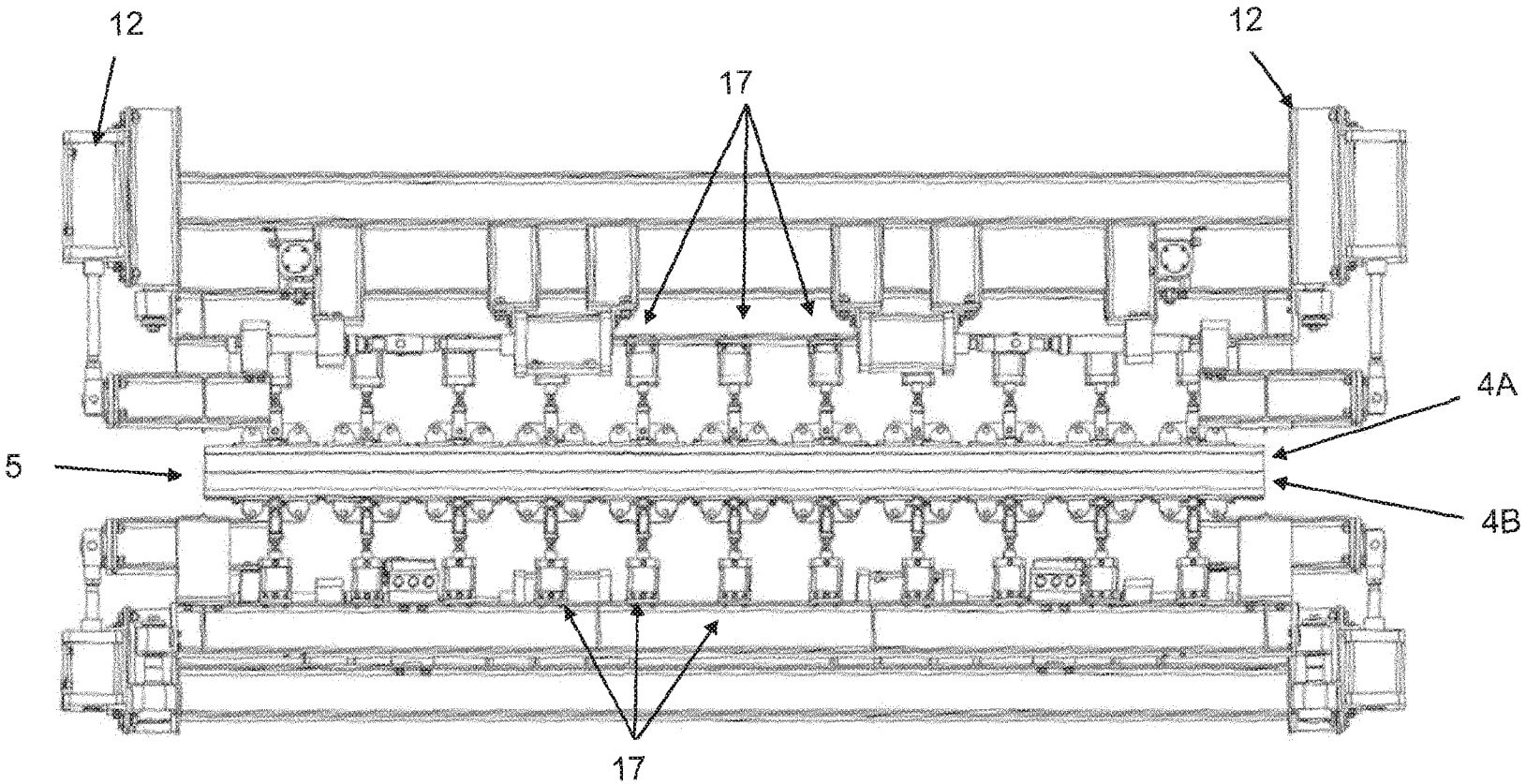
FIG. 5 shows an embodiment of the treatment chamber comprising a lower half-cell and an upper half-cell and positioning jacks as well as placement jacks for the cells.

As shown in FIG. 5, two half-cells, an upper half-cell 4A and a lower half-cell 4B, are positioned in use on either side of the workpiece to be treated 2, so as to create a tight chamber 5 centered on the entire length of the weld 16, where the required treatment will be applied.

Figure 9:
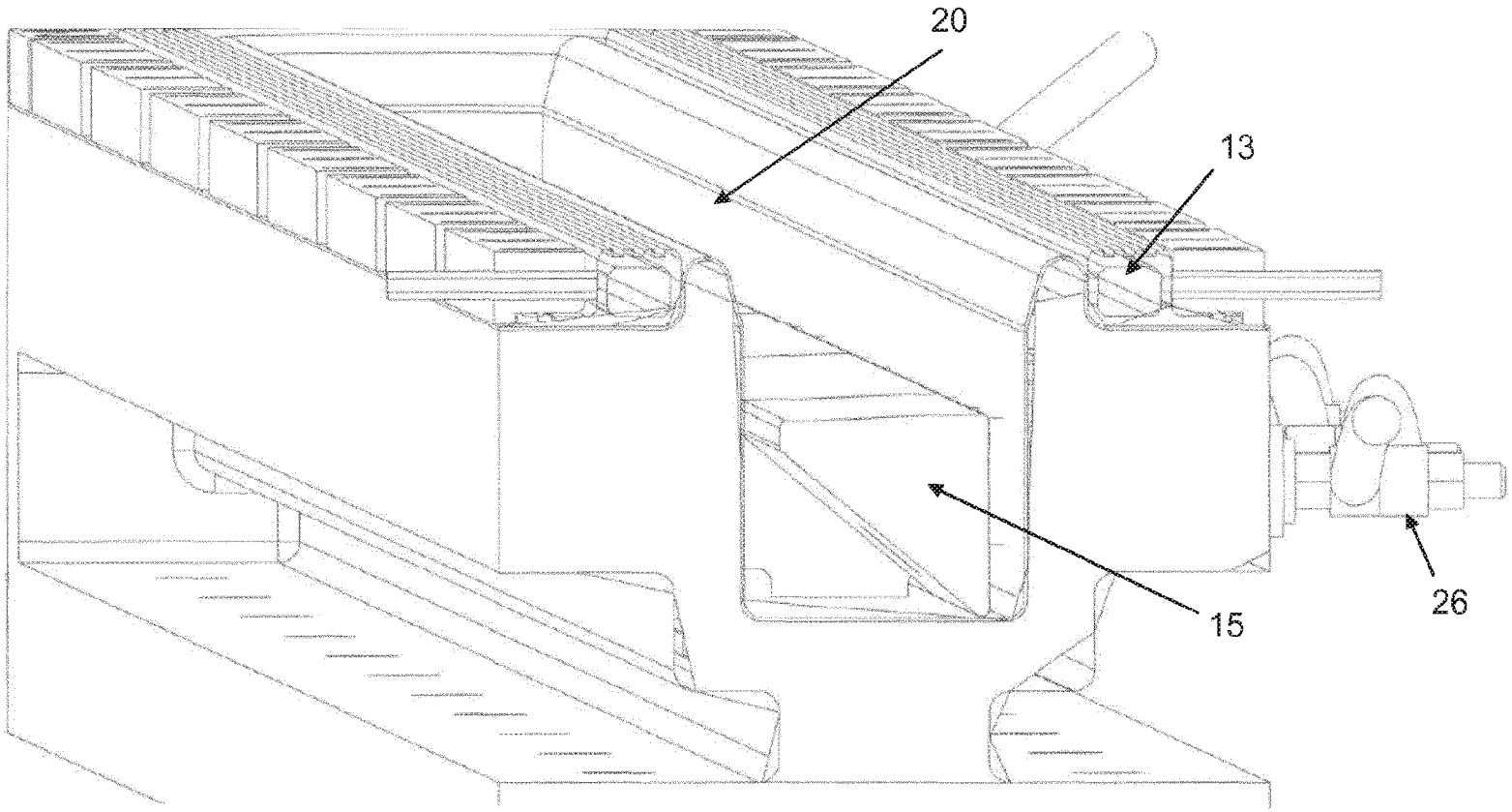
FIG. 9 is a perspective view of a half-cell according to the invention comprising an incorporated anodization electrode.

An anodization treatment of the weld can also be done owing to electrodes 15 provided in the cell 4A, 4B (see FIG. 9).

Large workpieces, for example like those in the aeronautics field, can easily be treated owing to such a system. One difficulty with thin workpieces, however, is that the pressure applied must be the same on each side to prevent them from deforming.

The surface treatment station 1 comprises the depositing station 11 of the workpiece as well as the set of treatment half-cells 4A, 4B. The handling gantry 7 places the workpiece on the treatment station by sliding the workpiece 2 between the depositing station 11 and the upper half-cells (not shown).

The half-cells 4A, 4B remain in place in the station 1, but are retracted when they are not in use. Their movement can for example be vertical or perpendicular relative to the positioning of the weld, for example with a travel of about 100 mm for the lower half-cells, and at least 400 mm for the upper half-cells, the latter may be provided by the positioning jacks 12 or any other similar assembly.

Figure 6:
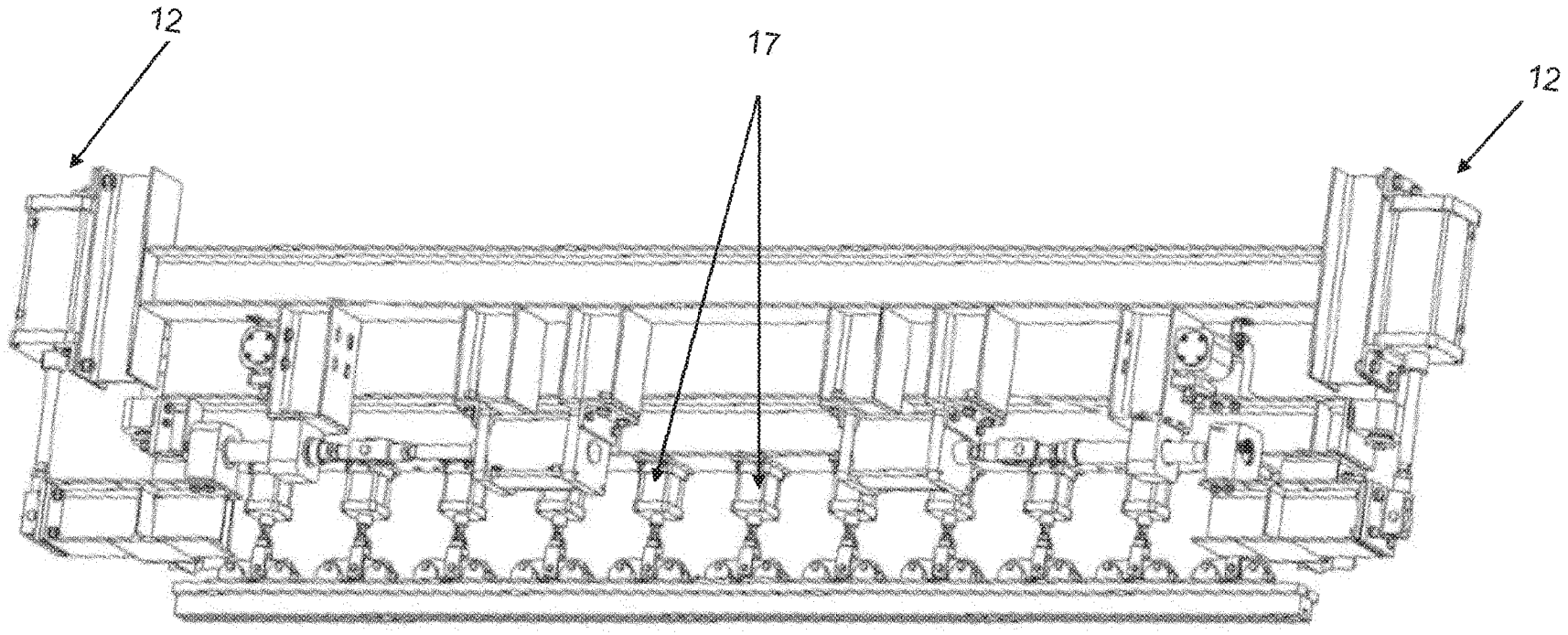
FIG. 6 shows a detail view of a half-cell with its positioning and placement jacks.

As illustrated by FIG. 5, on the one hand, positioning jacks 12 make it possible to position the two half-cells 4A, 4B precisely around the workpiece 2, or more specifically in the form of a jaw around the weld 16, so as to form the tight chamber 5. There will generally be two of these jacks per half-cell 4A, 4B. On the other hand, placement jacks 17 can further be provided to allow a precise placement of the chamber 5 on the workpiece 2. The placement jacks are illustrated in FIGS. 5 and 6, purely as an illustration; there are eleven of them, making it possible to distribute the pressure of the corresponding cell 4A, 4B over a maximum number of points to prevent the deformation of the workpiece 2. These placement jacks 17 are only absolutely necessary when the seal used is not an inflatable seal, that is to say, when it is necessary to provide a compression force.

Treatment Chamber

Figure 4:
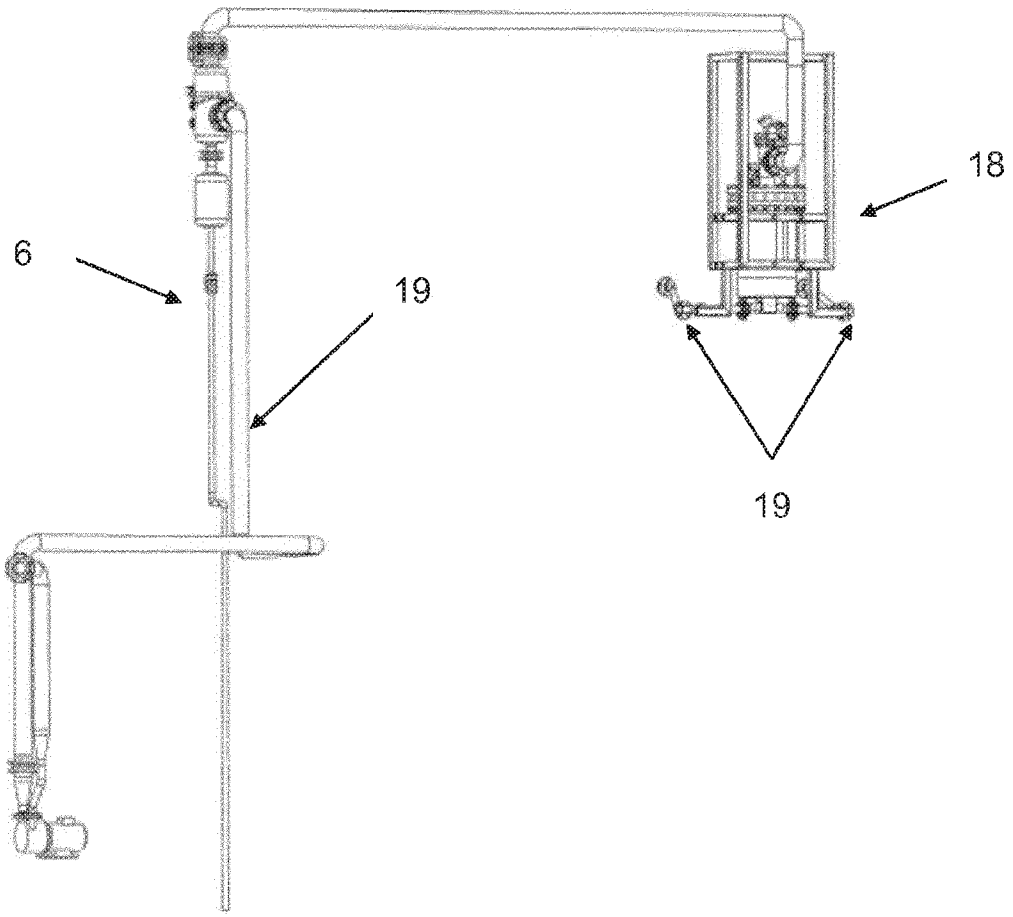
FIG. 4 shows an embodiment of a pressure-decrease system of the chambers as well as a vacuum-regulating balloon.
Figure 7:
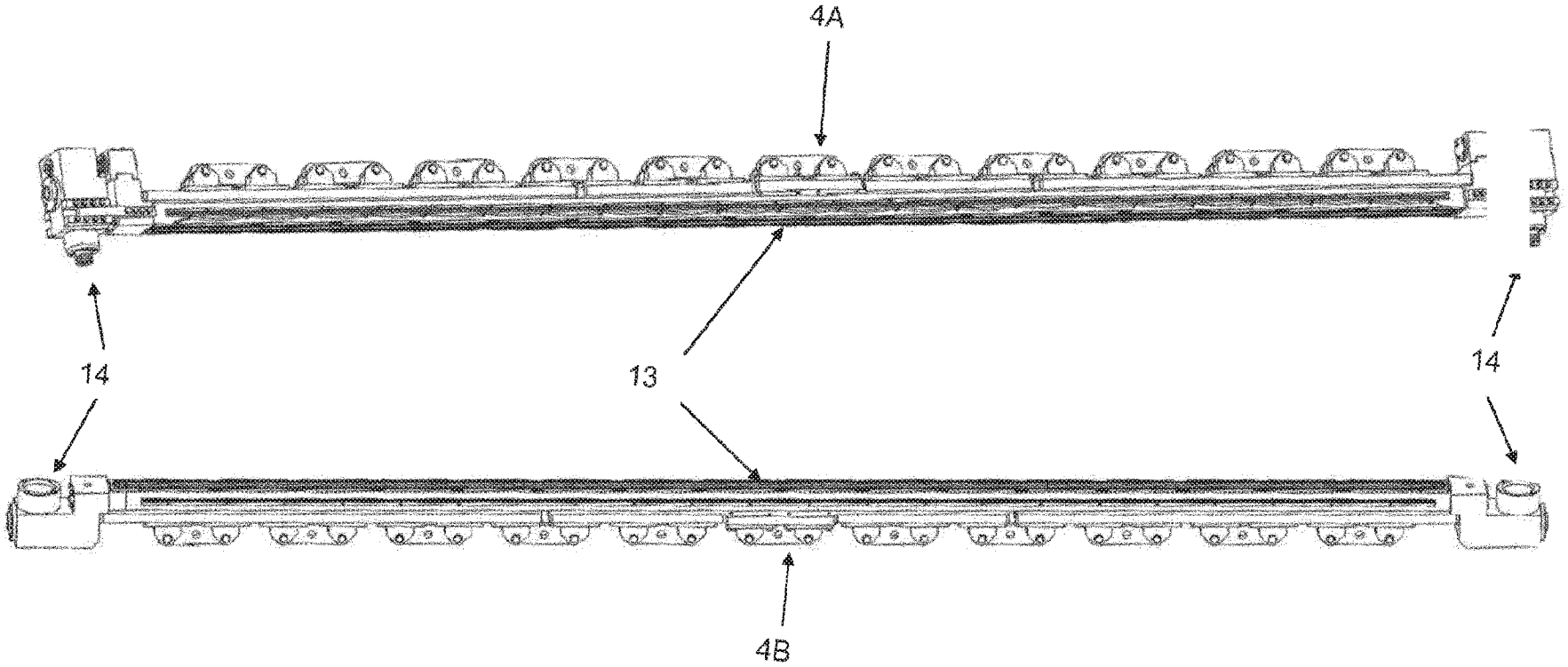
FIG. 7 shows an embodiment of the half-cells with inflatable seals located therein.
Figure 8:
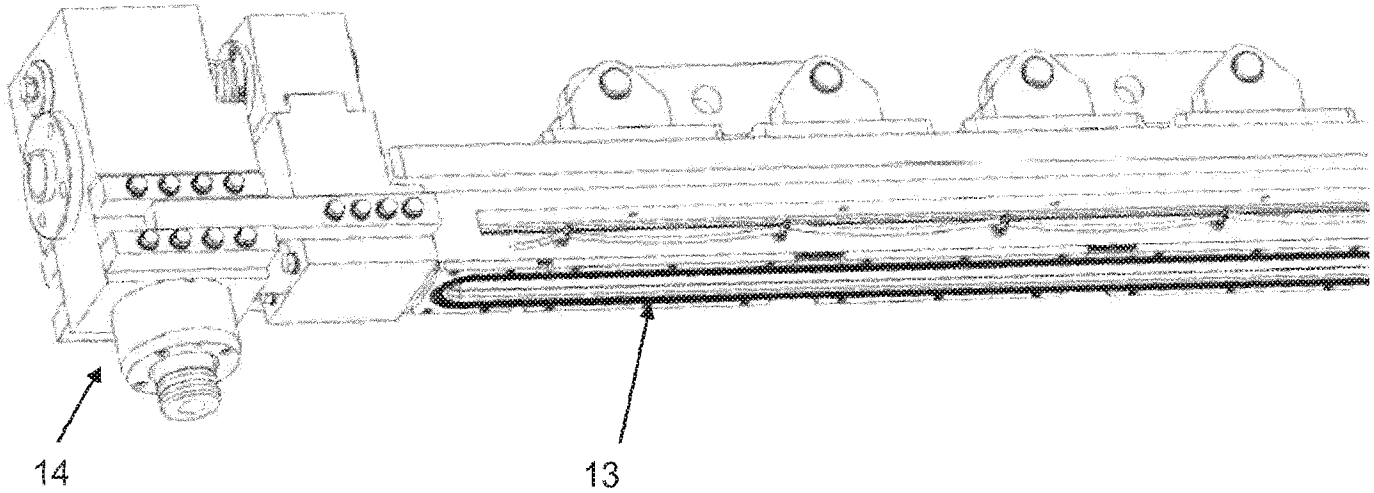
FIG. 8 shows a detail view corresponding to FIG. 7.

The treatment chamber 5 advantageously comprises the following equipment items and functionalities so as to allow the implementation of the required method:

treatment half-cells 4A, 4B;

a connection 14 between upper and lower half-cells allowing the transfer of liquids upstream and downstream of the treatment chambers 5 (FIGS. 7 and 8);

a pressure-decrease and filling system 6 of the treatment chambers 5 (FIG. 4);

anodization electrodes 15 and sets of bars and rectifiers (FIG. 9);

a drying system 21 of the treatment chamber (FIG. 2).

The two half-cells 4A, 4B are designed to make it possible to cover the entire weld 16 of the workpiece, that is to say, both of its faces/sides on either side of the workpiece 2 (FIG. 5). These are aligned on the axis of the weld 16 and are placed below and above the workpiece to be treated 2. Each chamber 5 creates tightness with the workpiece to be treated 2.

One or both cells 4A, 4B are advantageously removable so as to allow the depositing and picking up of the workpiece 2 on the tooling.

The interior shape of each half-cell 4A, 4B has a profile that makes it possible to ensure a discharge and rapid drainage of the walls. For example, they essentially have the form of half-tubes closed at their ends by an essentially spherical portion. The retention zones are thus minimized. If retention zones of the tooling remain, their content can then be advantageously suctioned using a Venturi or equivalent system so as to be returned into the supply and discharge pipings. To avoid any residual trace of liquid on the workpieces, a drying system outlined below can be provided.

Preferably, the open zone of the treatment chamber 5 is 45 mm wide and 50 mm high. The length of the treatment chamber 5 is limited by the length of the workpiece as well as by the remaining portion of the lugs 10B mentioned above so as to perform a treatment on the entire weld 16.

Although each half-cell 4A, 4B must be adapted to the geometry of the workpiece, its design will be such that a decrease in the section of the cell, and in particular its space requirement in terms of width, will still be possible based on the evolution of the method, so as to allow an adaptation to a narrower weld 16 and to perform a treatment in a confined location in terms of width (see FIG. 10).

Furthermore, the half-cell 4A, 4B is completely tight on the workpiece and its emptying must be quasi-complete. Tightness, as explained below, is achieved on the workpiece 2 as well as the remaining portion of the lugs 10B. The assembly of the equipment further has a slight incline (a slope of about 2%), for the discharge of the air during the filling phases and of the liquids during the emptying phases. Likewise, the discharge of gas pockets that may form during filling or during treatment phases must be discharged from the treatment chamber 5 by means of channels or as needed by the boring of holes in the lugs 10A, 10B located at the ends of the welds 16.

The material used for the treatment chamber 5 may require the use of a support to stiffen it and withstand the mechanical stresses. The choice of the materials for the chamber 5 as well as its support and their assembly mode take preferably account of the differential thermal expansion of the materials and their chemical resistance.

For example, the choice of polypropylene for the material of the chamber causes an elongation thereof of 45 mm at a temperature of 60° C. Thus, the half-cell 4A, 4B may be left free on the workpiece or conversely constrained on its support to reduce these expansion phenomena. The constraints caused by this contained expansion must be taken into account in the sizing of the workpieces. The cell will alternatively and preferably be made from coated steel or coated aluminum to have a thermal expansion coefficient that is identical or similar to that of the workpiece to be treated, for example with a coating in Halar® form.

The vats 3A to 3D are provided with all necessary instrumentation for the autonomous operation of the chamber 5 (temperatures, levels, pH, conductivity inter alia will be measured individually for each of the products used).

Connection of the Upper and Lower Cells

The connecting enclosures 14 of the treatment chambers 5 make it possible to provide the junction between the upper half-cells and the lower half-cells upstream and downstream of the latter and thus, using a common duct, to supply (or empty) the two half-cells at the same time and with the same solution. The connecting system 14 of the chambers must allow a tight connection between the two half-cells 4A, 4B. Preferably, this system 14 does not require human intervention for its implementation. Intervention may only be required for the locking thereof.

The connections between the chambers 5 have a tightness provided by the seals 13 (FIGS. 7, 8 and 9). Inflatable seals 13 may advantageously be used to perform this function.

The connecting system 14 also performs the filling functions upstream of the two half-cells 4A, 4B and must allow the discharge of air bubbles in the treatment chambers 5 downstream.

Another function of the connecting system 14 is to provide a good distribution of the flow rates between the upper and lower half-cells. The use of diaphragms, or any other system making it possible to ensure this distribution, may be required. As the flow rates between the treatment half-cells 4A, 4B have to be identical, an orifice is provided, making it possible to control and adjust this distribution of the flow rates. A flow rate measurement shared by all the products having to circulate in the treatment chambers 5 may be implemented.

Pressure-Decrease and Filling System for the Treatment Chambers

During the filling of the facility, the treatment chambers 5 obtained by the connection of the cells 4A, 4B are subject to pressure decrease so as to allow them to be filled with the different liquids coming from the storage vats 3A, 3B, etc. The circulation pumps are not used in this step. A balloon serving as expansion tank 18 is placed at a level higher than that of the treatment chambers 5 (FIGS. 2 and 4). This vacuum-regulating balloon 18 comprises various equipment items, including a connection to a system for generating pressure decrease 6 in the set of cells, pipings 19 that make it possible to create the vacuum in the circuit, and fluid connectors. The produced pressure decrease makes it possible to fill the assembly and allows the liquid to rise in this reservoir 18.

Once the facility is filled, the circulation pumps take over the treatment phase (not shown). The latter are installed downstream of the treatment cells 5 to maintain a slight pressure decrease during the treatment. The expansion tank 18 also makes it possible to discharge residual air or the gas produced by the treatment of the workpiece 2.

The system for generating pressure decrease 6 can be made in the form of a positive displacement pump or vacuum pump, suitable for ensuring the desired pressure decrease, and is connected to the half-cells 4A, 4B by a piping 19 through the expansion tank 18 and equipped with an automatic shutoff valve. A venting valve is also installed on this reservoir.

Preferably, a level verification function is installed on the expansion tank 18. During the filling phase, the fluid must reach a certain threshold before allowing the circulation pumps to start. Next, the fluid level is continuously verified during the treatment cycle to ensure good degassing of the chambers.

A pressure-measuring function in this balloon 18 or at the treatment chambers 5 can also be installed. This verifies the proper generation of the pressure decrease during the filling phase, and monitors the generation of the pressure decrease in the facility during the treatment phases.

Once the treatment cycle is complete, the assembly of the chambers 5, the expansion tank 18 and the pipings 19 is vented. The assembly is emptied by gravity, outside retention zones.

The waste from the pumping unit is channeled toward a treatment system for gaseous effluents.

The equipment items in contact with the workpiece to be treated 2 and the circuit portions shared by the various treatment solutions and rinse water preferably have the ability to empty out completely without leaving any dead volume. This emptying can be done by gravity (storage in tank below the treatment cells), but can also be assisted (by compressed air, for example).

Definition of Treatment Ranges

The equipment according to the invention can be used in steady state (therefore without circulation), but forced agitation may also be implemented, with the aim of making the treatments uniform, as well as providing the calories necessary for rapid heating and for maintaining the temperature of the chamber 5 and the workpiece to be treated 2. This agitation will be done by shear and turbulence of the flow.

A discharge velocity greater than 1 m/s will then preferably be ensured in the half-cells 4A, 4B. An alternative may complete this device by placing turbulence accelerators all along the half-cell. In this precise case, care will be taken not to locally disrupt the electrical field necessary for anodization.

Preferably, the heat losses are minimized owing to thermally-insulated ducts. The thermally-insulating thicknesses do not exceed 25 mm so as not to be a hindrance as regard to their space requirement, and thus avoid adding a significant heat mass hindering heat changes due to its inertia. The temperature vats exceeding 45° C. are also thermally insulated. Generally, any surface whose temperature can reach or exceed 50° C. will be thermally insulated in this way. Conversely, the half-cells 4A, 4B are not necessarily thermally insulated.

The heaters will be dimensioned so as to ensure uniformity of the temperature in the storage vats 3, in the ducts 22, 23 and in the cells 4A, 4B throughout the entire treatment time and for the highest values. During warm-up, the deviations must not exceed a total of 5° C. relative to the targeted value, while the variations will be +/−2° in steady state.

Anodization Electrodes

The cells 4A, 4B can be equipped with electrodes 15 allowing the anodization or any other electrochemical treatment of the workpiece to be treated (FIG. 9). These electrodes 15 are for example made from graphite, lead or stainless steel, with a preference for graphite, and placed inside the treatment chamber 5.

The shape of the electrodes 15 must not hinder the flow of liquid in the half-cells 4A, 4B, but may participate in increasing the turbulence therein. The profile of these electrodes 15 preferably must not have retention zones. To that end, they can for example have a flat, cylindrical or grid shape. According to the embodiment shown in FIG. 9, the electrodes are flat and have a triangular section.

The electrodes 15 will advantageously be made up of adjacent pieces making it possible to offset the expansion of the materials.

The anodization electrodes 15 are for example powered by a rectifier with a direct and smooth current, to allow the anodization of two treatment chambers 5 (not shown). The electrodes 15 are electrically connected to one another by a conductive material outside the treatment chamber 5. The electrodes 15 must be replaceable individually without having to disassemble all the connections.

The electrodes 15 ensure uniform current density on both faces of the workpiece and an identical distribution between the two half-cells 4.

For an optimal result, the treatment must be uniform over the entire length of the workpiece and over the entire treated width, and is identical on both the lower and upper faces. The distance between the electrodes and the zones to be coated is preferably uniform and sufficient to ensure the uniformity of the depositing thickness.

Drying System of the Treatment Chambers

After treatment and before opening of the half-cells 4A, 4B, the treated zones of the workpiece 2 are dried at the end of the treatment cycle. The use of dried and heated air will be favored to increase the effectiveness of the treatment. The drying is preferably done in about 5 minutes. The main workpiece of this system is an air heater making it possible to simultaneously increase the exchange capacity of the air with the humidity contained in the treatment chambers.

If necessary, the drying system can be completed by an air dehydrator by solid absorbents such as silica gel or molecular sieve. The air conveyed through this dehumidifier passes over a plate to be dried. The plate, support for the solid absorbent, is divided into two sectors. One allows the dehumidification of the air and the second allows the regeneration of the absorbent with a flow of dried, or even reheated air. The support is generally rotatable to allow the continuous recycling of the absorbent.

In addition to this drying, other solutions may be necessary to ensure the discharge of residual drops on the workpieces and the tools. Additional blowing or removable troughs may be necessary so as not to have residual water on the workpiece before or during its transfer to the following station.

The drying will be limited to the treatment chambers 5 with the exclusion of feed-pipes and any liquid-retention zone. This will make it possible to limit the volume of water to be discharged to the treatment chambers 5 (zones that will open during the movement phases of the workpiece).

The discharges of drying air at the outlet of the chamber 5 containing steam will be sent directly to an air washer 6 before being discharged. The materials used must be compatible with the temperatures of the system. A shell or flame trap may be installed on the discharge network.

Opening/Closing System

The opening/closing system of the treatment chambers 5 makes it possible to move the latter and to ensure a sufficient approach and hold in position throughout the entire treatment cycle.

This system can be mechanical, electrical, hydraulic or pneumatic and is able to ensure a slow movement of the treatment chambers 5 (to avoid drips and stresses on the workpieces). It compensates for the incline of the workpiece 2 and makes it possible to release the treatment half-cells 4A, 4B enough to allow the passage of the workpieces and their handling system.

The actuators of the system must be guided if their section or design does not make it possible to ensure a repetitive movement and positioning. Guide columns then make it possible to ensure the repetitiveness of the movements. If several actuators are used, the movements must be perfectly coordinated.

The treatment chambers 5 may be secured in the open position by pinning or by a latch. Furthermore, the system must also make it possible to hold the half-cells 4A, 4B in position during the treatment phases and to offset any possible pressure force inside the treatment chambers 5 and that of the sealing gasket 13.

The open and closed positions of the treatment chambers 5 will be controlled by end-of-travel sensors.

The opening/closing system will take account of any expansions of the treatment chambers 5 and their carriers while respecting the flexural stresses.

Sealing System

The sealing system is a system that ensures the tightness between the treatment cell 5 and the workpiece to be treated 2. The sealing system, housed in the treatment half-cell 4A, 4B, are supported by the workpiece to be treated 2 to perform the sealing.

The sealing of the treatment chambers 5 is preferably provided by a seal 13 made from a flexible material that is compatible with the different treatments defined in the AIPI (Airbus Process Instruction). This seal 13 must withstand the products contained in the treatment chamber 5. The seal 13 is placed at the periphery of the weld in the longitudinal direction. It is also supported by the lug portions 10B (see above) on either side of the weld 16.

This seal 13 must be capable of following the curve radius necessary for joining the cells 4 together while ensuring the tightness of the chambers 5 with the workpiece 2. It must also be capable of compensating for the curve radius of the lower surface of the workpiece as well as the acceptable bending of the treatment chambers 5. Lastly, it will be chosen based on its ability to minimize the leaks of liquid or air in case of nonplanar surfaces in the upper portion.

Inflatable seal technologies, or flexible seal technologies compatible with and coupled to an inflatable seal, are preferred for this application. The forces of this type of seal on the workpieces to be treated 2 and the treatment chambers 5 must be taken into account.

Storage Vats

These vats 3A, 3B, 3C, etc. make it possible to store and heat treatment products. They are arranged side by side in the station 1 but in a tank, at a lower level relative to the treatment chambers 5 so as to allow a gravitational return toward the tanks of the fluids having been successively transferred into the chambers for treatment. Preferably, the depth of this tank will be of about 2.5 to 3.5 m, this depth being determined by the required accessibility to the equipment items, instruments and samples.

The vats 3A, 3B, 3C, etc. are grouped together by treatment function. Each set of vats comprises one enclosure for the treatment product and two enclosures for the associated rinses. These enclosures are closed by lids that allow access for the maintenance of the equipment items inside the vats as well as cleaning thereof.

All the automatic addition or transfer valves between the baths are equipped with a manual shutoff valve upstream. One must be able to empty the insulated segments for safe interventions. Additionally, the additions of water or transfers from baths are controlled by a flowmeter.

The additions of water can also be done manually using a manual valve in parallel with the automatic valve.

The assemblies of storage vats 3A, 3B, 3C, etc. are similar in terms of design and are installed on independent retention means so as not to cause mixing of products in case of leak.

Transfer of Baths

The transfer of the baths between the treatment vats 3A, 3B, 3C, etc. and the treatment chambers 5 is provided by a set of pipings 22, 23. This connection system 22, 23 makes it possible to automatically transfer all the supply needs to the treatment chambers 5. It ensures a sufficient flow rate to prevent heat losses of the workpiece and to ensure the method times.

The pipings are made while taking account of the constraints relative to mechanical strength, support, expansion phenomena. In the case of horizontal ducts, taking the operating temperature of the facility into account can streamline the continuous support of the pipings with an outer diameter of less than 50 mm. This continuous support can be done for example in iron angles, a U-shaped or semi-round profile made from metal materials or from thermosetting plastic.

Special attention must be paid to the emptying phase of the pipings so that the latter do not comprise retention zones. Additionally, one should be able to empty these pipings completely for maintenance purposes and they should not comprise residual liquids. The low points will be equipped with manual or automatic emptying valves if these low points may "pollute" the following steps of the method.

The pipings can be thermally insulated so as to limit heat losses during liquid transfers.

This set of pipings can be protected from impacts by mechanical protection in the passage zones for personnel and handling vehicles. The pipings conveying products that are hazardous for operators will be protected by masks or protection to prevent sprays. Flange connectors must be protected by a flexible anti-spray cover. Any sprays upon pipe breakages will be channeled toward the retention means.

The distribution feed-pipes will be installed near the storage vats 3A, 3B, 3C, etc. to reduce the multiple lengths of pipings as well as the electrical cabinet. The inlet and outlet feed-pipes make it possible to connect the different preparation and storage vats to the treatment chambers 5. These feed-pipes all comprise the shutoff valves coming from the vats. During the filling phase of the treatment chambers 5, a set of valves opens to allow the liquid to pass. During the emptying phase, the same set of valves opens to allow the liquid to return toward the storage vat. The feed-pipes are designed not to create liquid retention. Machined workpieces will be preferred so as to obtain a collector with no retention zones.

Use and Advantages of the Invention

This type of solution can be used in different industries in which a surface treatment is necessary to manufacture the product or a portion of the finished product and when this treatment must be done locally on the surface. This type of solution can also be implemented during maintenance or repair operations (fuselage of active airplane, vehicle body, etc.). For example, it makes it possible to prepare a surface before applying the adherence accelerator necessary for paint thereon. The application being tight, the adjacent surfaces and the operators are thus protected. The pressure decrease and the tightness thus allow a treatment on any surface, with a nonplanar geometry and, within certain limits, non-continuous geometry, for example a domed surface or a locally grooved surface. It also provides the interesting advantage of being implementable irrespective of the orientation of the surface to be treated. Lastly, the pressure decrease not only ensures tightness, but also contributes to the placement of the treatment cell on the workpiece. A pressure decrease of 100 mbar contributes, for a surface area of 4 $dm^2$, to a pressing force of 400 Newton.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 Local surface treatment station
2 Workpiece to be treated
3A, 3B, 3C, 3D Storage vats
4A Upper half-cell
4B Lower half-cell
5 Chamber
6 Pressure decrease system (and air washer)
7 Handling gantry
9 Boring ("locating")
10A Removable lug portion (for specimen)
10B Remaining lug
11 Depositing station
12 Positioning jack
13 Sealing gasket
14 Connecting system (or enclosure)
15 Anodization electrode
16 Weld
17 Cell placement jack
18 Vacuum-regulating balloon
19 Vacuum duct
20 Opening of the half-cell
21 Air suction and air dryer
22 Treatment fluid supply duct (filling)
23 Treatment fluid emptying duct
24 First type of seal
25 Second type of seal
26 Power supply
27 FSW weld and borders of the uncoated zone

The invention claimed is:

1. A station for localized surface treatment of an industrial workpiece to be treated, comprising:

at least one treatment chamber comprising a cell or two half-cells, each cell or half-cell being configured to delimit a tight space between walls of the cell or half-cell and a respective portion or face of the industrial workpiece, the cell or each half-cell comprising a wall having an opening configured to cover a corresponding portion or face of the industrial workpiece, the opening of the cell or half-cell being delimited by a continuous sealing gasket, the cell or each half-cell comprising positioning means, the at least one treatment chamber comprising a supply and emptying circuit;

a plurality of storage vats each configured to contain a treatment fluid, the supply and emptying circuit connecting each storage vat to the at least one treatment chamber so as to supply the at least one treatment chamber with respective treatment fluids, the plurality of storage vats being located at a lower level than the at least one treatment chamber; and a system configured to decrease pressure, with respect to atmospheric pressure, of the at least one treatment chamber and the supply and emptying circuit, so as to permit, upon a pressure decrease, the supplying and emptying of the at least one treatment chamber by suctioning respective treatment fluids from the plurality of storage vats, through the supply and emptying circuit, and to the at least one treatment chamber when the supply and emptying circuit is at atmospheric pressure, due to a return of the respective treatment fluids to the plurality of storage vats, wherein the continuous sealing gasket is configured to ensure the tight space delimited between the walls of the cell or half-cell and the respective portion or face of the industrial workpiece by inflating the continuous sealing gasket with air to a pressure of between 0 and 5 bars once the positioning means have positioned the cell or each half-cell at several tenths of a millimeter from a surface of the industrial workpiece.

2. The station for localized surface treatment according to claim 1, wherein the cell or each half-cell comprises a metal coated on surfaces thereof in contact with the treatment fluids by a coating configured to withstand corrosion by the treatment fluids and operating temperatures, or comprises synthetic materials.

3. The station for localized surface treatment according to claim 1, wherein the continuous sealing gasket comprises an inflatable lip seal.

4. The station for localized surface treatment according to claim 1, wherein the system configured to decrease pressure comprises at least one vacuum pump, a vacuum-breaker valve configured to measure and regulate vacuum, and a seal pot or vacuum-regulating balloon, the seal pot being connected to the vacuum pump by a condenser configured to condense vapors generated by the pressure decrease.

5. The station for localized surface treatment according to claim 4, wherein the vacuum pump comprises a liquid-ring centrifugal pump.

6. The station for localized surface treatment according to claim 1, wherein the supply and emptying circuit comprises thermally insulated pipes.

7. The station for localized surface treatment according to claim 1, wherein the at least one treatment chamber comprises at least one turbulence accelerator configured to agitate the treatment fluid in the tight space.

8. The station for localized surface treatment according to claim 1, wherein the cell or each half-cell comprises an electrode for an electrochemical treatment of the industrial workpiece.

9. The station for localized surface treatment according to claim 1, further comprising:

a handling gantry configured to transport the industrial workpiece from a depositing carrier of a previous station to a depositing carrier of the treatment station, the handling gantry having a variable diameter that permits the handling gantry to approach the industrial workpiece without touching it, and suction devices configured to provide contact and holding by pressure decrease of the industrial workpiece with the depositing carrier.

10. The station for localized surface treatment according to claim 1, further comprising:

a structure configured to retract and position the treatment cell or half-cells, the structure comprising a plurality of positioning jacks configured to position the cell or the half-cells on each side of and near the industrial workpiece.

11. The station for localized surface treatment according to claim 1, wherein the station is configured to apply a localized surface treatment on large industrial workpieces having lugs at each end of a weld, the lugs being centered on an axis of the weld, the lugs having either a removable part that is detachable and usable as test specimen or as a remaining part which may be bored to allow communication of treatment fluids between the half-cells.

12. The station for localized surface treatment according to claim 11, wherein a tightness of the at least one treatment chamber is ensured by positioning the continuous sealing gasket longitudinally on each side of the weld and on the remaining part of the lugs at the ends of the weld.

13. A production line for industrial workpieces, comprising:

a first assembly station for the industrial workpieces comprising a welding step to provide produced welds;

a second nondestructive testing station for the produced welds;

the station for localized treatment of the industrial workpieces according to claim 1; and a final inspection station for the treated industrial workpieces.

14. The station for localized surface treatment according to claim 1, wherein the pressure is between 1 and 2 bar.

15. The station for localized surface treatment according to claim 2, wherein the synthetic materials comprise polypropylene or polyvinylidene difluoride.

16. The station for localized surface treatment according to claim 3, wherein the inflatable lip seal comprises ethylene propylene diene monomer.

17. A method for localized surface treatment of an industrial workpiece to be treated implementing the treatment station according to claim 4, the method comprising:

setting a pressure-decrease level in the system configured to decrease pressure, at a value that is at most 500 mbar lower than the atmospheric pressure;

opening valves and filling, by suction, the seal pot or vacuum-regulating balloon up to a predetermined level with a treatment fluid from one of the plurality of storage vats;

circulating, by pumping, the treatment fluid and filling the at least one treatment chamber;

treating the industrial workpiece to be treated;

stopping the circulation of the treatment fluid; and stopping the pressure decrease, returning to atmospheric pressure and emptying, by gravity, the treatment fluid to the one of the plurality of storage vats.

18. The method according to claim 17, comprising repeating the treating with different fluids so as to provide a treatment cycle.

19. The method according to claim 18, wherein at an end of the treatment cycle, treated zones of the industrial workpiece are dried by dried and heated air for about 5 minutes.

20. The method of claim 17, wherein the method is used in a manufacturing process to ensure a functionality or an additional assembly, or during a maintenance or repair operation of an industrial workpiece that is already in use.

* * * * *